United States Patent [19]

Matthias et al.

[11] Patent Number: 4,821,665

[45] Date of Patent: Apr. 18, 1989

[54] SUBMERSIBLE ROV FOR CLEANING AND INSPECTING METAL

[75] Inventors: Brian P. Matthias; Richard C. Mursinna; Felixberto A. Galasan, all of San Diego, Calif.

[73] Assignee: Honeywell Inc., Minneapolis, Minn.

[21] Appl. No.: 163,171

[22] Filed: Feb. 26, 1988

Related U.S. Application Data

[63] Continuation of Ser. No. 840,115, Mar. 13, 1986, abandoned.

[51] Int. Cl.[4] ..... B63B 59/08

[52] U.S. Cl. ..... 114/222; 114/221 A; 901/1; 901/44; 364/507

[58] Field of Search ..... 114/221 R, 221 A, 222, 114/312, 313, 322, 330, 331, 333, 337, 338; 901/41, 44, 45, 1, 50; 364/513, 506, 507; 318/588, 589; 166/337, 356

[56] References Cited

U.S. PATENT DOCUMENTS

| | | | |
|---|---|---|---|
| 3,469,627 | 9/1969 | Baker | 166/368 |
| 4,444,146 | 4/1984 | De Witz | 114/222 |
| 4,462,328 | 7/1984 | Oram | 114/222 |
| 4,502,407 | 3/1985 | Stevens | 114/222 |

*Primary Examiner*—Sherman D. Basinger
*Assistant Examiner*—Clifford T. Bartz
*Attorney, Agent, or Firm*—W. T. Udseth

[57] ABSTRACT

A submersible ROV removes extraneous material from the surface of submerged metal with a cleaning tool and measures the thickness of the metal with an ultrasonic probe. A camera allows visual operation of the ROV. The cleaning tool and ultrasonic probe can reach areas of limited access making the ROV useful for inspecting the interior of holding tanks. A submersible, electrical power supply can be combined with the ROV to provide an intrinsically safe system which is particularly useful in environments where sparks pose a substantial hazard.

5 Claims, 7 Drawing Sheets

SUBMERSIBLE ROV FOR CLEANING AND INSPECTING METAL

This application is a continuation of application Ser. No. 840,115, filed Mar. 13, 1986, now abandoned.

BACKGROUND OF THE INVENTION

1. FIELD OF THE INVENTION

This invention relates to submersible, remotely operated vehicles (ROVs) which clean metallic surfaces and use ultrasound to measure the thickness of the metal.

2. RELATED ART

Metal which has corroded, rusted or accumulated other extraneous matter such as tar and barnacles due to submersion in water or oil, must often be inspected to insure its continued viability. Inspection requires that the metal surface first be exposed.

The metal walls of oil tanker holds are one example of such metal. When the hold is drained of oil, it is often filled with seawater. Presently, the hold walls are inspected manually while dockside by lowering a small boat and people into the hold, and having the boat manuever around the hold's perimeter while the water level in the hold is lowered. Extraneous matter attached to the metal surface at a desired inspection site is scraped away with hand tools. Once exposed, the thickness of the metal is checked.

Not only is manual inspection of oil tanker holds difficult and inefficient, the toxic fumes accumulated in the confines of the unfilled portion of the hold provide a potentially hazardous environment.

Remotely operated underwater vehicles have been used for inspection for years. Television camera have been incorporated in various ROVs and manipulator arms have been attached. The maneuverability of such ROVs in restricted areas has been limited however, and an ROV which can clean and check the thickness of metal walls in such close confines as a tanker hold has not heretofore been disclosed.

Further, the flammable materials in environments such as tanker holds makes the use of electrical equipment above the surface of the water very dangerous. All prior submersible ROV systems have employed electrical supplies located on the surface. A spark or explosion in such a supply may cause a secondary explosion. Such systems are therefore not "intrinsically safe" An intrinsically safe submersible ROV system for cleaning and inspection of metal is clearly desirable, but heretofore unknown.

SUMMARY OF THE INVENTION

The present invention is a submersible ROV which can clean extraneous material from metal walls and determine the thickness of the metal. The ROV releasably secures itself near the site to be inspected with, for example, a suction pump system. A cleaning means such as a milling tool strips the extraneous matter. The cleaning tool is moved aside and an ultrasonic head extended to measure the thickness of the metal by directing ultrasonic energy into the metal. The entire operation is conducted in full view of a camera included in the ROV.

For tight maneuvering, the cleaning and inspecting means are preferably located near the extremes of the vehicle carriage so that access by the cleaning and inspecting means will not be unduly constrained by the carriage.

Preferably, the cleaning means and ultrasonic head are disposed along a common axis so that the cleaning means can clean a site, be rotated aside, and the ultrasonic head extended along the axis to precisely contact the cleaned site.

The present invention also provides an intrinsically safe submersible, ROV metal cleaning and inspection system by combining the above described ROV with a submersible electrical power supply. The power supply is driven by a nonelectrical water motor so that no power is generated above the surface. The only link to the electronics in the deck house surface console is a fiber optic link, which is itself intrinsically safe.

DESCRIPTION OF THE PREFERRED EMBODIMENT

Figure 1:
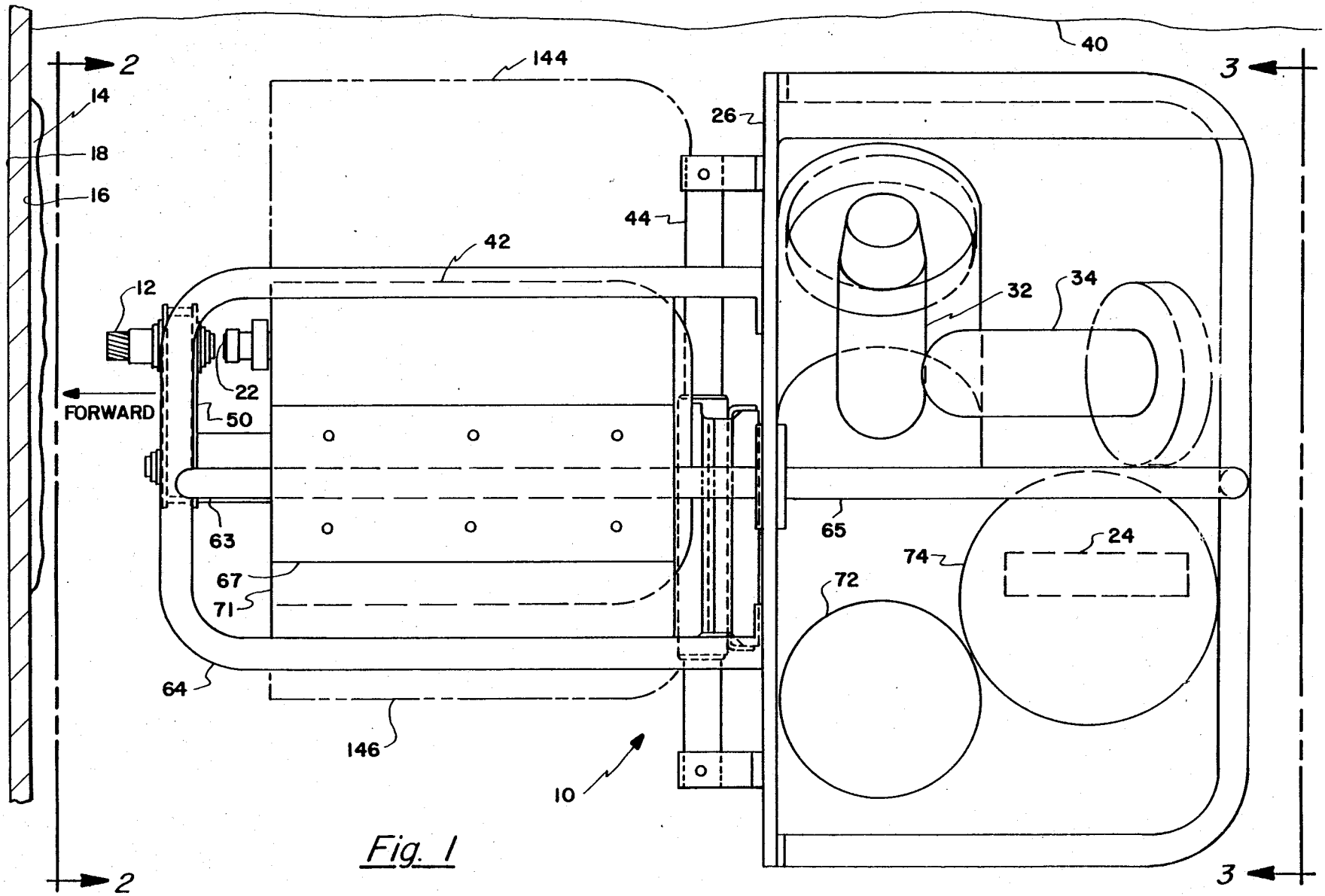
FIG. 1 is a side view of an ROV in accordance with the present invention.
Figure 2:
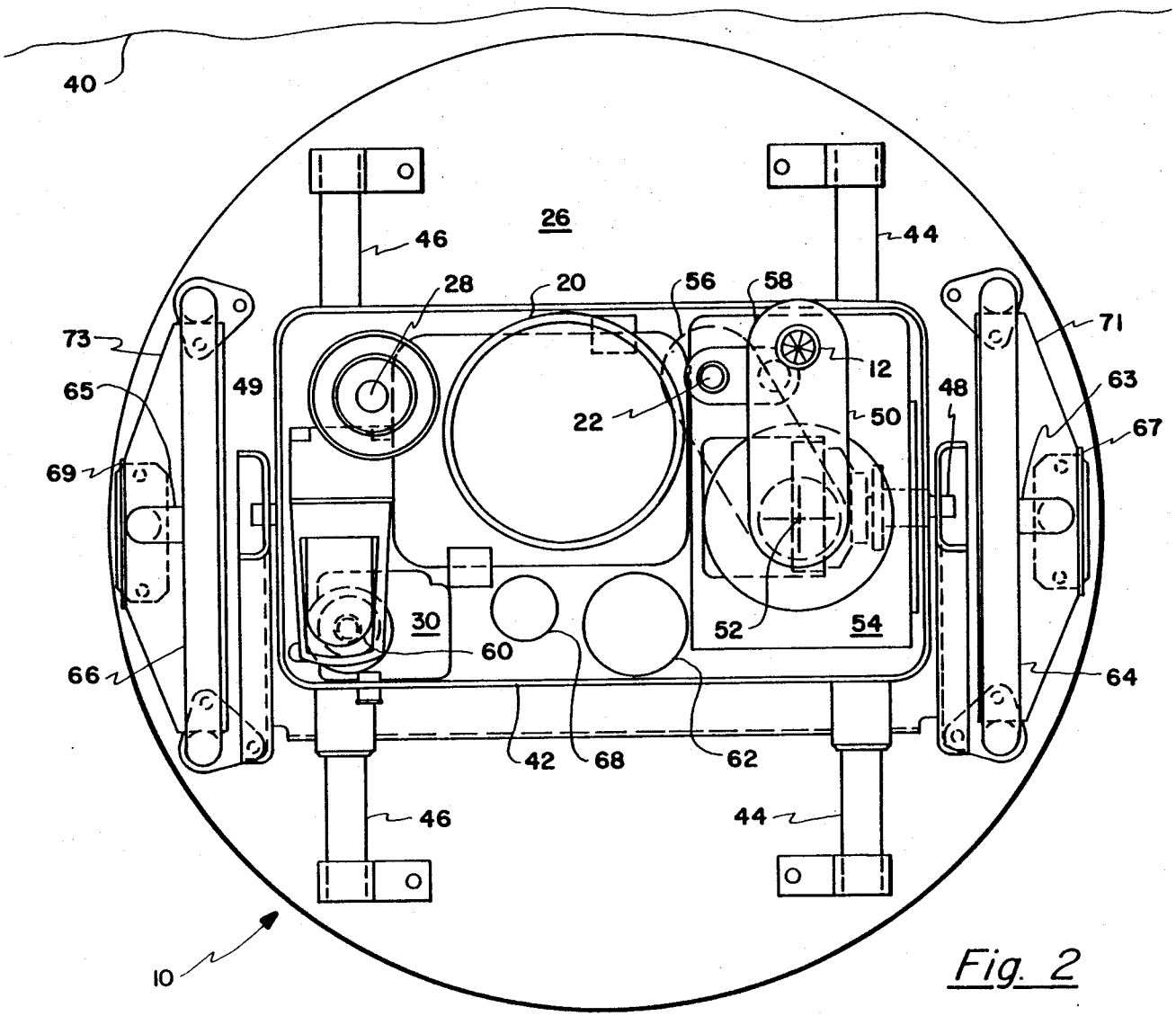
FIG. 2 is a front view of the ROV of FIG. 1 taken along line 2—2.
Figure 3:
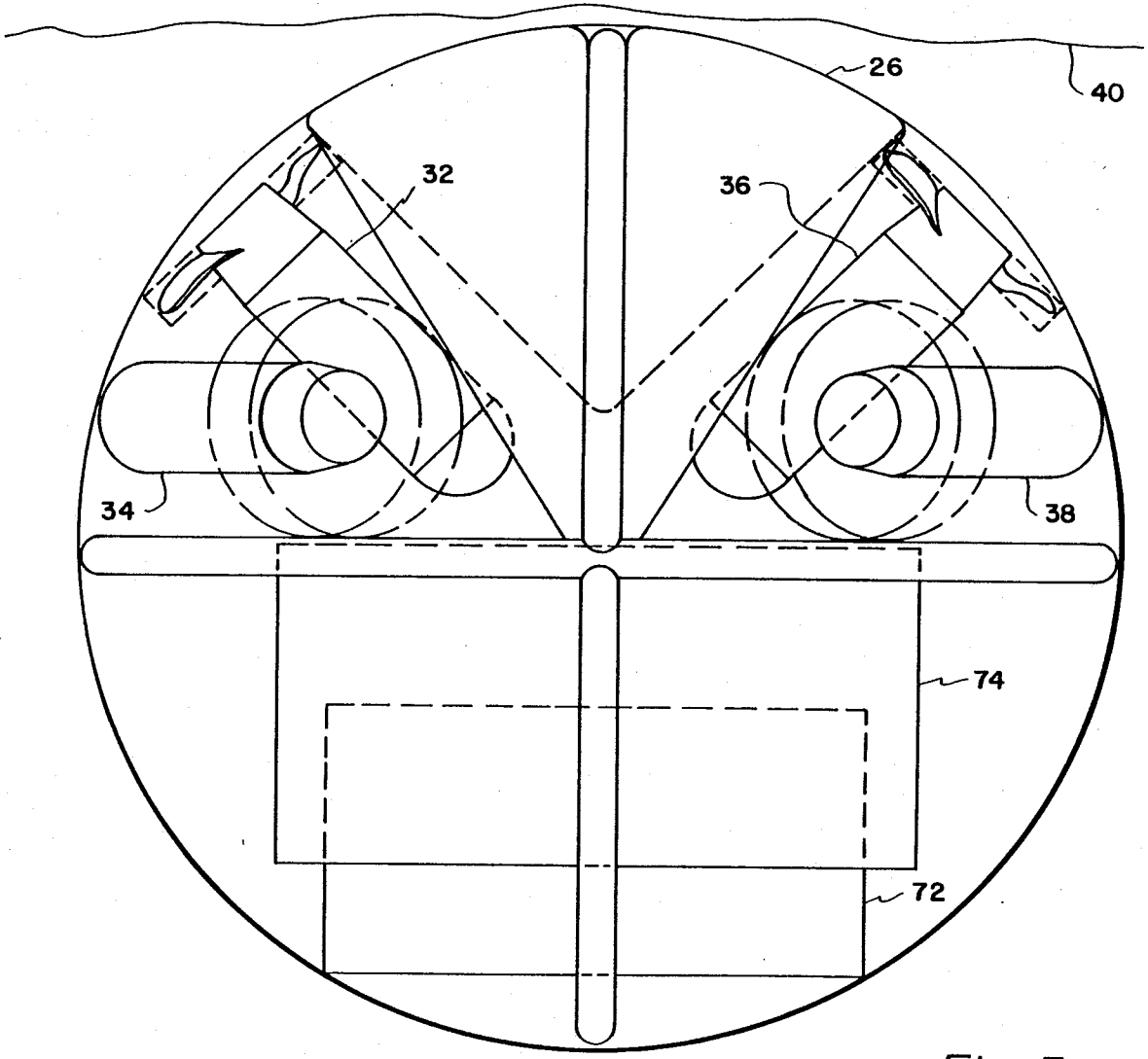
FIG. 3 is a cutaway, rear view of the ROV of FIG. 1 taken along line 3—3.
Figure 6:
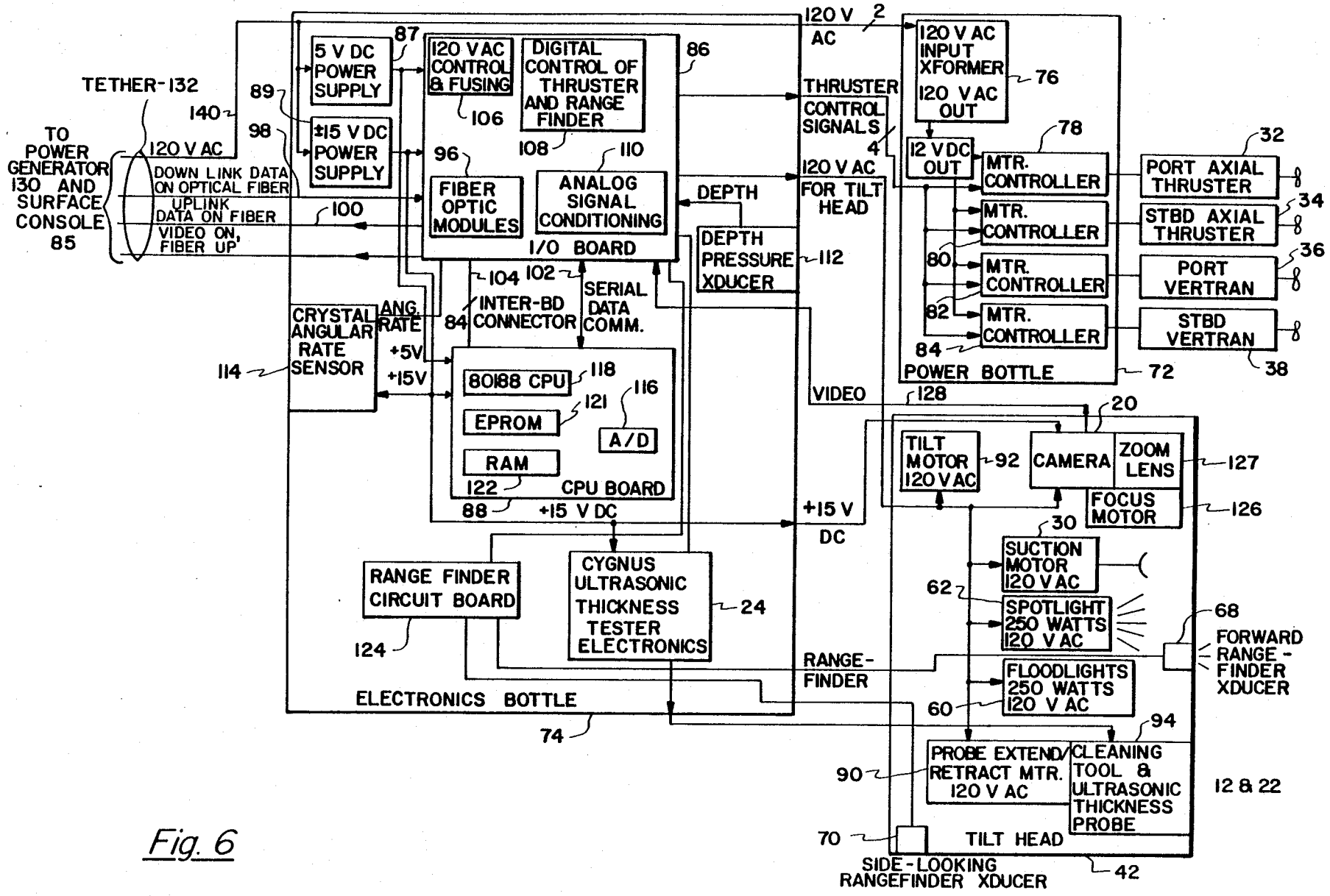
FIG. 6 is a block diagram of the electronics of the ROV of FIG. 1.
Figure 7:
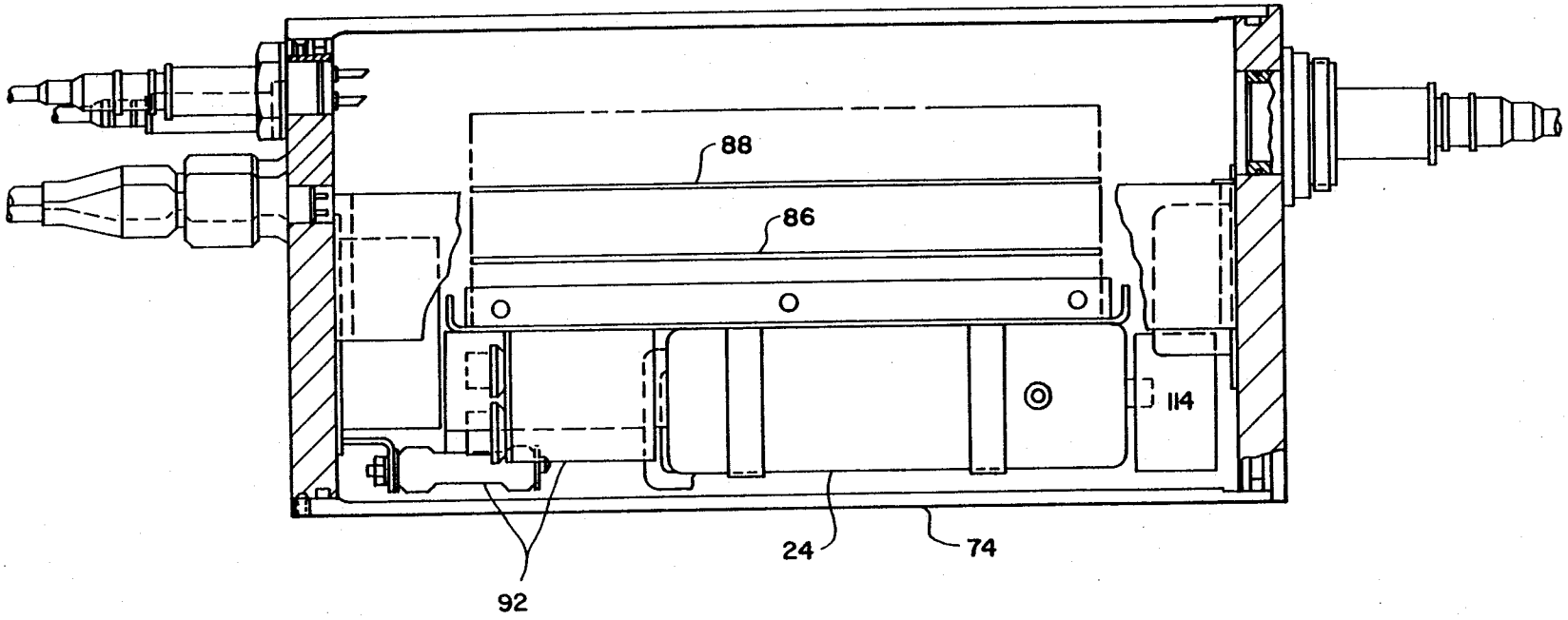
FIG. 7 is a cutaway of the electronics bottle of FIG. 3.

Submersible ROV 10 of FIG. 1 includes: a means for removing (such as milling tool 12) extraneous material 14 attached to a location 16 on a metal wall or surface 18, means for viewing (such as camera 20) the site cleaned by the removing means, means for measuring the thickness of metal wall 18 (such as ultrasound head 22 and associated electronics 24) carriage means 26 for supporting the removing means, the viewing means and the thickness measuring means, means for releasably securing (such as suction cup 28 and suction pump 30, see FIGS. 2 and 6 for pump 30) carriage means 26 to metal wall 18 and means for moving (such as the thrusters 32, 34, 36 and 38) carriage means 26 in water 40. The buoyancy of ROV 10 can be adjusted by securing flotation devices and or ballast tanks to carriage 26.

Preferably milling tool 12, ultrasound head 22 and camera 20 are supported by a means (such as tilt head 42) which is movably secured to carriage 26. In particular, tilt head 42 is slidably attached to rods 44 and 46 and can rotate about pivot points 48 and 49.

Figure 5:
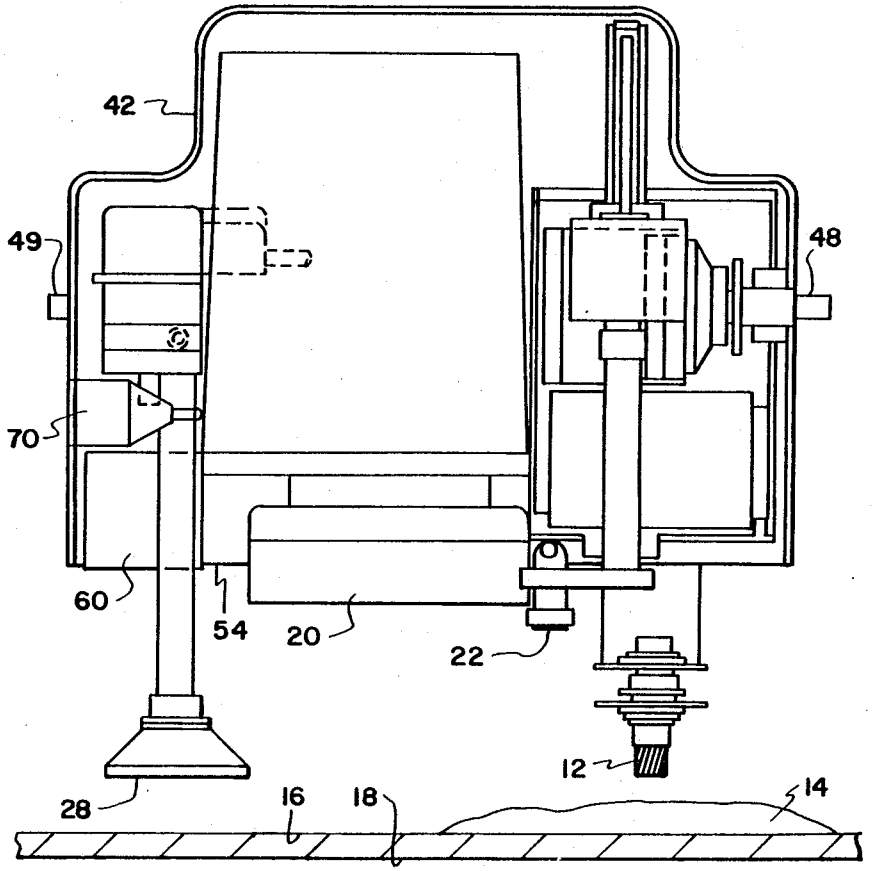
FIG. 5 is a top view of the tilt head of FIG. 4 taken along line 5—5.
Figure 4:
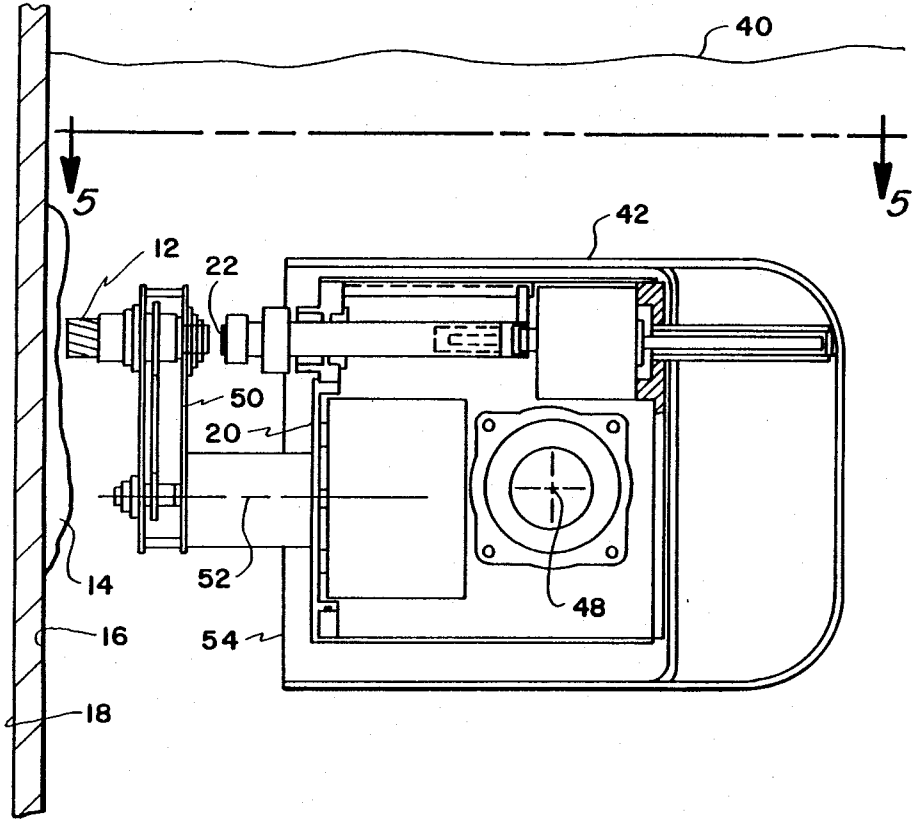
FIG. 4 is a cutaway side view of the tilt head of the ROV of FIG. 1.

Conveniently, milling tool 12 is located near the end of arm 50. Arm 50 can rotate about axis 52 in a plane parallel to the face 54 of tilt head 42, from a first position 56 to a second position 58 (see FIG. 2). Tilt arm 50 is torsionally spring loaded to the first position 56. Ultrasound head 22 is extendably secured (e.g., by a threaded shaft driven axially) to tilt head face 54 and in axial alignment (see FIG. 5) with second position 58 (i.e., the cleaning and inspecting position).

Light 60 (see FIG. 2) illuminates the inspection site 16. Light 62 is used for long range viewing only. Standoff bars 64 and 66 are a convenient way to position tilt head 42 relative to metal wall 18. Bars 63 and 65 provides added strength to carriage 26. Plates 67 and 69 secure buoyancy materials 71 and 73, respectively, to bars 63 and 65. Sonars 68 and 70 allow determination of distance in two, orthogonal directions.

Electrical power and control is provided, for example, through a power bottle 72 and an electronics bottle 74 (see FIG. 6)—both packed within the bottom of carriage 26. The following is a description of a convenient electronic circuit for use in ROV 10.

Power bottle 72 receives 120 VAC and steps that down and converts it to DC with transformer/rectifier 76 to 12 VDC. The 12 VDC supplies power to the four thruster controllers 78, 80, 82 and 84 through a high current relay in the form of a pulse width modulated signal.

Figure 8:
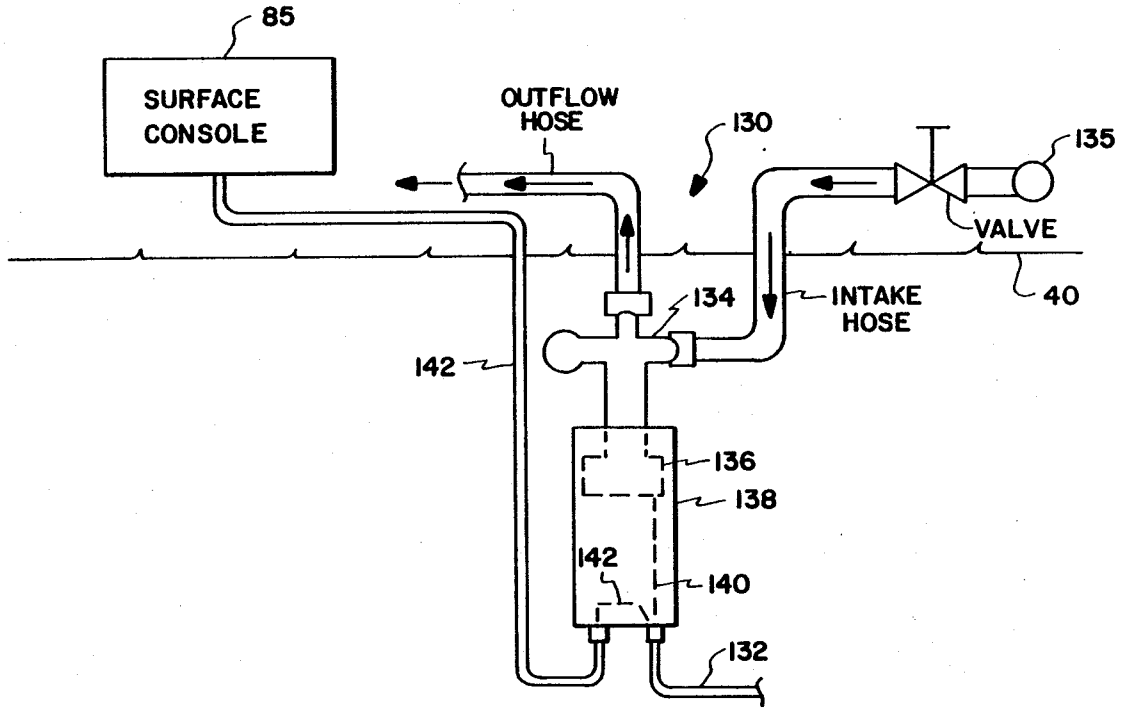
FIG. 8 is a schematic of an intrinsically safe system employing the ROV of FIG. 1 and a water driven, submersible electrical power supply.

Electronics bottle 74 preferably includes an input-/output printed circuit board (I/O Bd. 86) for routing and controlling signals and a central processing printed circuit board (CPU board 88) which contains the control programs and executes instructions in response to commands input at a remote surface console 85 (see FIG. 8). Electronic bottle 74 also receives 120 VAC and steps it down and rectifies it in 5 v DC power supply 87 and ±15 v DC supply 89.

The I/O board 86 provides circuitry (e.g., relay/drivers) to take in the logic level (e.g., 5 v) control signals from CPU board 88 and control the 120 VAC power devices. These power devices are the thruster motors power switch (not shown), the ultrasonic probe position motor 90, the tilt head motor 92, the cleaning motor 94, suction motor 30 and lights 60 and 62.

I/O board 86 includes a bank of fiber optic modules 96 for receiving and transmitting optical data along optical down link 98 and optical up link 100, respectively. Module 96 performs opto-electrical conversion on signals input thereto. Command signals will be transmitted from a surface console along down link 98, converted to electrical signals in modules 96, transmitted to CPU board 88 along serial data bus 102. Thereafter, CPU board 88 will pass data back along interboard connect 104 to control the various ROV components through relay/drivers (not shown) on I/O board 86.

I/O board 86 includes a 120 VAC control and fusing circuit 106 for directing 120 VAC to many of the components on tilt head 42. Digital control signals from CPU board 88 will operate relay/drivers on I/O board 86 to turn these components on or off in response to command signals input at surface console 85.

A digital control circuit 108 for thrusters 32, 34, 36 and 38 is on I/O board 86. Circuit 108 responds to digital signals from CPU board 88 to selectively control the duration of the pulse width modulated power signal to the four thruster controllers 78, 80, 82 and 84.

Analog signal conditioning circuit 110 on I/O board 86 receives analog signals from depth pressure transducer 112, angular rate sensor 114, a potentiometer (not shown) indicating the angular position of tilt head 42 and a signal indicative of voltage magnitude on the 120 VAC line. The CPU board 88 has an A/D converter 116 with (typically) a larger ± voltage range than the input analog signal. Circuit 110 will scale these analog signals to the range of the A/D convertor 116 by level shifting. If the analog signal range is smaller than the range of A/D converter 116, as is often the case, such scaling will increase signal resolution.

A convenient angular rate sensor 114 is a Watson Industries single axis angular rate sensor which uses a pair of piezoelectric vibrating beam elements. Torque applied to the elements due to rotation in the water generates a signal indicative of the magnitude and direction of rotation.

CPU board 88 conveniently includes a CPU 118 (e.g., an Intel 80188 16 bit microprocessor) with additional memory afforded by electrically programmable ROM 121 and RAM 122. EPROM 121 holds the basic programming to control the ROV electronics and RAM 122 allows for in operation modifications of selected aspects of the system. Further, the operator at surface console 85 can annotate the display of the video signal from camera 20 with identification data for a particular run of ROV 10.

In addition to directing digital control signals to I/O board 86, CPU board 88 can derive azimuth from data from angular rate sensor 114 and depth from depth transducer 112 data.

RAM 122 can also store data on the route of a particular ROV run so that suspect sites on wall 18 can be easily found on future runs.

The distance that ROV 10 is from objects during its course is derived by sonars 68 and 70 and range finder circuit board 124. An amplifier circuit is included in board 124. Since the strength of a sonar return signal rapidly diminishes with distance, it is preferable to provide the rangefinder circuitry with time variable gain (i.e., TVG). TVG increases the amplifier gain as time increases to compensate for the weakness in signals being returned from remote objects, thus retaining a desired level of signal resolution. The time for the return signal to be received is, of course, indicative of the distance from the object.

Additionally, a grid scaled to represent distance can be superimposed on a video display on surface console 85. The dimensions of the grid can be varied (by CPU board 88) as the distance of ROV 10 from an object varies to give the operator real time information on the distance that camera 20 is from an object.

Camera 20 may employ a focus motor 126 (preferably controlled through I/O board 86) and a zoom lens 127. Video signals are transmitted from camera 20 along video link 128 to I/O board 86 for transmission to surface console 85.

Additional preferable features (not shown) in ROV 10 are closed loop servo systems to maintain heading and depth (located in CPU board 88), manual override of the servo-loops, and circuitry to detect water intrusion into the power or electronics bottles.

FIG. 8 displays a schematic of an intrinsically safe submersible electrical power supply 130 which is particularly suited for connection to tether 132 of ROV 10. The primary components of power supply 130 are a water driven mechanical energy source such as water driven motor 134, an electrical generator 136 for converting the mechanical energy to electrical energy, a housing 138 which is water impermeable, and a power cable 140 for transmitting electrical energy to the ROV 10.

A reaction type of water driven motor (i.e., wherein the water can discharge against a back pressure and be piped away to a convenient point) is preferred as motor 134. Motor 134 is powered solely by water pressure produced, for example, by the water supply 135 of a ship. This hydro-motive force requires no electrical source on deck and therefore minimizes the chances of sparks being released above the surface of the water.

When electrical power supply 130 is used with ROV 10, it is convenient to include a fiber optic cable 142 which couples to the surface console 85, and is co-extensive with power cable 140 between housing 138 and ROV 10 to form a single tether 132 for ROV 10. Use of a fiber optic cable 142 will also avoid passing an electrical cable from surface console 85 through a hazardous surface environment.

A more detailed description of power supply 130 is included in a U.S. patent application entitled "Submersible Electrical Power Supply", assigned to the assignee of the present application and filed on the same date as the present application, this other patent application being incorporated herein by reference.

In operation, thrusters 32, 34, 36 and 38 are activated to move ROV 10 adjacent site 16. ROV 10 can be held against wall 18 at a fixed distance by pressing standoff bars 64 and 66 against wall 18 with the thrusters. Generally light 60 will be used to properly illuminate site 16 for camera 20. Suction cup 28 will engage wall 18. Milling tool 12 is rotated to cleaning position 58 and tool 12 activated. It is preferable to have the face of tool 12 form a small angle (typically a few degrees) with the surface of wall 18 so that the blades of tool 12 will cut smoothly without "chatter".

Extraneous material 14 is removed by tool 12, thereby exposing metal wall 18. The removal operation is monitored visually with camera 20 and is terminated when wall 18 is exposed. Tool 12 is rotated via a camming surface to position 56 as ultrasound head 22 is extended to engage wall 18. Head 22 typically has a flat face which should be positioned flush against wall 18. Head 22 in conjunction with electronics 24 will then send an ultrasonic signal into wall 18. The opposite face of wall 18 will reflect a portion of the initial ultrasonic signal back to head 22. The ultrasonic electronics 24 will determine the thickness of metal wall 18 by measuring the time for the return signal.

The location of site 16 can be recorded in RAM 122 by processing data from depth sensor 11, rangefinders 68 and 70 and angular rate sensor 114. ROV 10 can disengage by retracting head 22, stopping the pump for suction cup 28, retracting cup 28 and reverse thrusting with selected thrusters.

Clearly the process can be continued to inspect all desired sites. To perform the operation in an intrinsically safe manner, power supply 130 must be submerged prior to activation of supply 130 or ROV 10.

The present invention is particularly suited for use in the holds of oil tankers, but any metal which one wants to inspect which is submerged at the time of inspection can be cleaned and its thickness measured with the present invention. Storage tanks on land or the exterior hull of a ship are examples of other metal walls which may be inspected with this invention.

The embodiment depicted in FIG. 1 affords access to tight spots by allowing tilt head 42 to run up to position 144 (or down to position 146) in FIG. 1. Where the height of carriage 26 in FIG. 1 is about 23 inches, this places ultrasound head 22 about 2 inches from the uppermost part of ROV 10. One could manuever ROV 10 to touch the upper wall of a holding tank, run tilt head 42 up bars 44 and 46, and extend head 22 to the edge of standoff bars 64 and 66. This allows head 22 to reach any point on wall 18 except for a 2 inch strip adjacent the corner of wall 18 and the top of the tank.

One could also variously position head 22 on an extended arm to allow access to even the few inches that the device of FIG. 1 cannot reach.

Note further that tilt head 42 can tilt about points 48 and 49. This allows head 22 to be extended at various angles with regard to carriage 26. However, the ultrasonic head 22 should be placed flush against the metal wall being inspected to insure accurate thickness measurements, and if the site to be inspected is curved too sharply (e.g., a corner), one will be unable to properly position head 22. The device of FIG. 1 includes 1/10 horsepower thrusters 32, 34, 36 and 38. If ROV 10 were to be used in a lake or particularly the open sea, more powerful motors are preferred.

ROV 10 can be used in oil tankers while the same are underway, thus freeing the inspection process from dockside.

What is claimed is:

1. A submersible, remotely operated device for cleaning and inspecting metal, said metal being underwater and said device being controlled from a surface location, comprising:

means for removing extraneous material attached to a site on the surface of said metal;

means for viewing said metallic surface, said viewing means being positioned so that said site can be viewed;

means for measuring the thickness of said metal at said site, wherein said measuring means directs ultrasonic energy into said metal and makes physical contact with said metal in order to measure said thickness;

carriage means for supporting said removing means, said viewing means and said thickness measuring means;

means for releasably securing said carriage to said metallic surface; and means for moving said carriage in water, said means for moving including propellers.

2. The device of claim 1, further including:

means for selectively varying the position of said removing means from a first to a second position, wherein said first position is the position where said removing means will be operated and wherein said first position places at least a portion of said removing means in physical contact with said extraneous material; and means for selectively extending a portion of said thickness measuring means to said first position, so that said thickness measurements can be made at the same position cleaned by said removing means when said removing means is moved from said first position.

3. The device of claim 2, further including:

means for determining the location of said device in water and generating data indicating said location;

means for storing said location data;

means for selectively accessing said location data; and means for controlling said carriage moving means with said location data so that said device can be navigated automatically.

4. The device of claim 1, wherein:

a selected part of said removing means and a selected part of said thickness measuring means are adapted to engage said site, and wherein said selected parts of said removing means and said thickness measuring means are capable of being positioned adjacent selected boundaries of said device, so that said device can clean and inspect metal located in areas of restricted dimensions.

5. A system for remotely cleaning and inspecting metal, said metal being underwater, comprising:

a submersible, remotely operated vehicle including:

means for removing extraneous material attached to a site on the surface of said metal;

means for viewing said metallic surface, said viewing means being positioned so that said site can be viewed;

means for measuring the thickness of said metal at said site, wherein said measuring means directs ultrasonic energy into said metal;

carriage means for supporting said removing means, said viewing means and said thickness measuring means;

means for releasably securing said carriage to said metallic surface;

means for moving said carriage in water; and means for controlling said vehicle from a surface location, said controlling means including a fiber optic cable and wherein said control signals are directed along said fiber optic cable; and a submersible, electrical energy supply, including:

means for producing a force in response to fluid pressure, said fluid pressure being the sole source of energy for said force producing means;

means for converting said force to electrical energy;

housing means for containing said force converting means, said housing being impermeable to water; and means for transmitting said electrical energy to said remotely operated vehicle.

* * * * *